US006296403B1

(12) United States Patent
Duchovne

(10) Patent No.: US 6,296,403 B1
(45) Date of Patent: Oct. 2, 2001

(54) DUAL-MODE PRINTER FOR FLEXIBLE AND RIGID SUBSTRATES

(75) Inventor: Yoram Duchovne, Shearey Tikva (IL)

(73) Assignee: Scitex Vision Ltd., Herzlia (IL)

( * ) Notice: Subject to any disclaimer, the term of this patent is extended or adjusted under 35 U.S.C. 154(b) by 0 days.

(21) Appl. No.: 09/362,046

(22) Filed: Jul. 28, 1999

(51) Int. Cl.[7] ..... B41J 3/28

(52) U.S. Cl. ..... 400/23; 400/29; 400/31

(58) Field of Search ..... 400/23, 29, 30, 400/31, 44; 101/41

(56) References Cited

U.S. PATENT DOCUMENTS 3,477,322 * 11/1969 Gerber et al. ..... 33/1
4,301,999 * 11/1981 Higgins et al. ..... 269/21
4,665,619 * 5/1987 Pearl ..... 33/32.4
4,916,819 * 4/1990 Gerber ..... 33/18.1
5,027,133 * 6/1991 Weiselfish ..... 346/136

FOREIGN PATENT DOCUMENTS

4120293 * 2/1992 (DE) ..... 33/34

* cited by examiner

*Primary Examiner*—John S. Hilten
*Assistant Examiner*—Minh Chau
(74) *Attorney, Agent, or Firm*—Mark M. Friedman

(57) ABSTRACT

A dual-mode printer for printing on both flexible and rigid substrates includes a table providing a substantially planar support surface for supporting a substrate. A flexible-substrate feed system is configured to feed a flexible substrate in a given feed direction across the support surface. The printer has a print head configured for depositing a printing medium on a substrate as part of a printing process. A motion system is configured to generate relative displacement between the print head and the support surface in at least a first direction parallel to the feed direction. This combination of components allows the printer to be used in a flexible-substrate mode in which relative displacement between the substrate and the print head is generated at least in part by the flexible-substrate feed system and in a rigid-substrate mode in which relative displacement between the substrate and the print head is generated exclusively by the motion system.

12 Claims, 5 Drawing Sheets

DUAL-MODE PRINTER FOR FLEXIBLE AND RIGID SUBSTRATES

FIELD AND BACKGROUND OF THE INVENTION

The present invention relates to printers and, in particular, it concerns a dual-mode printer for printing on both flexible and rigid substrates.

There exist many printer configurations for printing on flexible substrates. These range from sheet-fed paper printers up to large format roll-to-roll and roll-to-sheet printers for printing on continuous webs of various materials such as paper, adhesive vinyl, cloth and PVC. Two examples of the latter types are shown in FIGS. 1 and 2.

In general terms, all such printers have a feed system including various rollers 10 configured to feed the flexible substrate in a given feed direction between a print head 12 and an opposing support strip 14. Depending on the type of print head and the width of the substrate, a motion system (not shown) may be used to scan the print head in a direction perpendicular to the feed direction. Relative displacement between the substrate and the print head parallel to the feed direction, on the other hand, is typically generated exclusively by the feed system.

There exist many applications in which printed matter is to be displayed on rigid substrates. This is most commonly achieved by printing on flexible substrates and then attaching the flexible substrate to the rigid substrate. However, this procedure is clearly inefficient and wasteful.

In the field of plotters, commonly used for technical drawings and plans, it is known to attach a substrate, typically paper, to a large support surface and to displace a print head, typically in the form of a pen, across the surface in two dimensions.

Although the applicant is not aware of any such system, it would appear possible to employ the plotter-type configuration to design a printer for rigid substrates along the lines illustrated in FIG. 3. Here, the rigid substrate 20 would be attached to a support surface 22 and a print head 24 would be moved over it in at least one, and typically two, dimensions by a motion system 26, 27.

While the printer of FIG. 3 would provide a solution for printing on rigid substrates, provision of a specialized rigid-substrate printer will in many cases not be economically or logistically viable.

There is therefore a need for a dual-mode printer for printing on both flexible and rigid substrates.

SUMMARY OF THE INVENTION

The present invention is a dual-mode printer for printing on both flexible and rigid substrates.

According to the teachings of the present invention there is provided, a dual-mode printer for printing on both flexible and rigid substrates, the printer comprising: (a) a table providing a substantially planar support surface for supporting a substrate; (b) a flexible-substrate feed system including at least one roller, the flexible-substrate feed system being configured to feed a flexible substrate in a given feed direction across the support surface; (c) a print head deployed in facing relation to the support surface and configured for depositing a printing medium on a substrate as part of a printing process; and (d) a motion system associated with the print head and the table, and configured to generate relative displacement between the print head and the support surface in at least a first direction.

According to a further feature of the present invention, the first direction is parallel to the feed direction, the dual-mode printer being usable in a flexible-substrate mode in which relative displacement between the substrate and the print head is generated at least in part by the flexible-substrate feed system and a rigid-substrate mode in which relative displacement between the substrate and the print head is generated exclusively by the motion system.

According to a further feature of the present invention, the motion system is further configured to displace the print head relative to the support surface in a second direction perpendicular to the feed direction, the motion system being operative to displace the print bead in the second direction during printing in both the flexible-substrate mode and the rigid-substrate mode.

According to a further feature of the present invention, the print head has a major dimension and a minor dimension, the major dimension being deployed substantially perpendicular to the feed direction.

According to a further feature of the present invention, the print head has a major dimension and a minor dimension, the major dimension being deployed substantially parallel to the feed direction, the motion system being configured to displace the print head exclusively in a direction substantially perpendicular to the feed direction.

According to a further feature of the present invention, the printing medium is an ink and wherein the print head is an inkjet head.

According to a further feature of the present invention, the table includes a retention system for holding the rigid substrate in a given position on the support surface.

According to a further feature of the present invention, the retention system includes a vacuum system configured to apply suction to a plurality of apertures formed in the support surface.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is a dual-mode printer for printing on both flexible and rigid substrates.

The principles and operation of printers according to the present invention may be better understood with reference to the drawings and the accompanying description.

Figure 4:
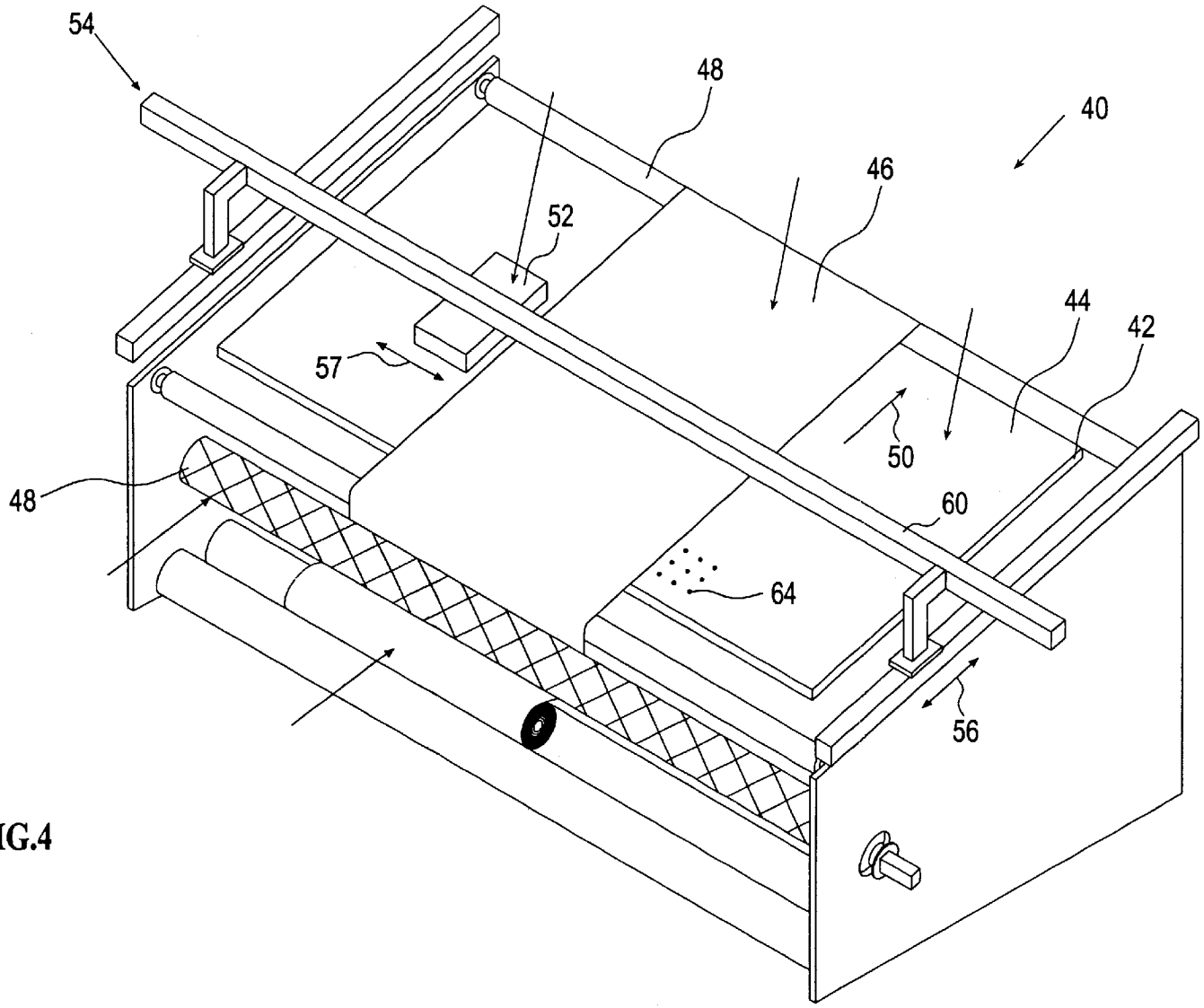
FIG. 4 is a schematic isometric view of a dual-mode printer, constructed and operative according to the teachings of the present invention, for printing on both flexible and rigid substrates.
Figure 5:
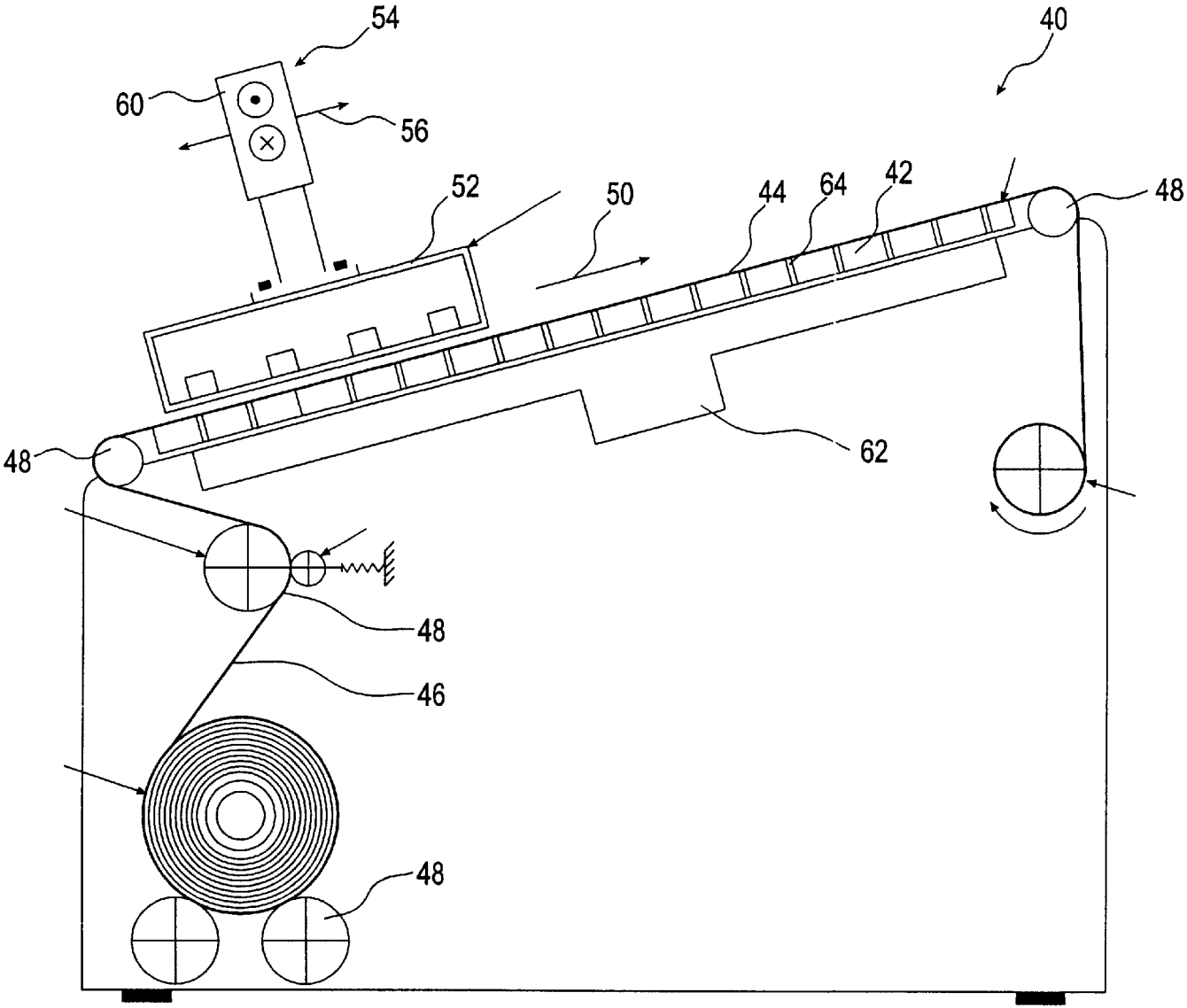
FIG. 5 is a schematic side cross-sectional view of the dual-mode printer of FIG. 4.

Referring now to the drawings, FIGS. 4 and 5 show a dual-mode printer, generally designated 40, for printing on both flexible and rigid substrates. Generally speaking, printer 40 has a table 42 providing a substantially planar support surface 44 for supporting a substrate, in the case illustrated, a flexible substrate 46. A flexible-substrate feed system, including at least one roller 48, is configured to feed flexible substrate 46 in a given feed direction 50 across support surface 44. A print head 52 is deployed in facing relation to support surface 44 and is configured for depositing a printing medium on substrate 46 as part of a printing process. A motion system 54, associated with print head 52 and table 42, is configured to generate relative displacement between print head 52 and support surface 44 in at least one direction.

As a result of the combination of the feed system and motion system 54, dual-mode printer 40 may be used effectively for printing both on flexible and rigid substrates. Motion system 54 ensures that print head 52 can be moved as required across a rigid substrate while the feed system makes the printer useful for flexible substrates such as for roll-to-roll and roll-to-sheet applications.

It will be apparent that the principles of the present invention may be applied to printers with various different modes of operation. In a first preferred example, motion system 54 is configured to generate relative displacement between print head 52 and support surface 44 in at least a first direction 56 parallel to feed direction 50. In this case, dual-mode printer 40 is usable in a flexible-substrate mode in which relative displacement between the substrate and the print head is generated at least in part by the flexible-substrate feed system and a rigid-substrate mode in which relative displacement between the substrate and the print head is generated exclusively by the motion system.

Figure 1:
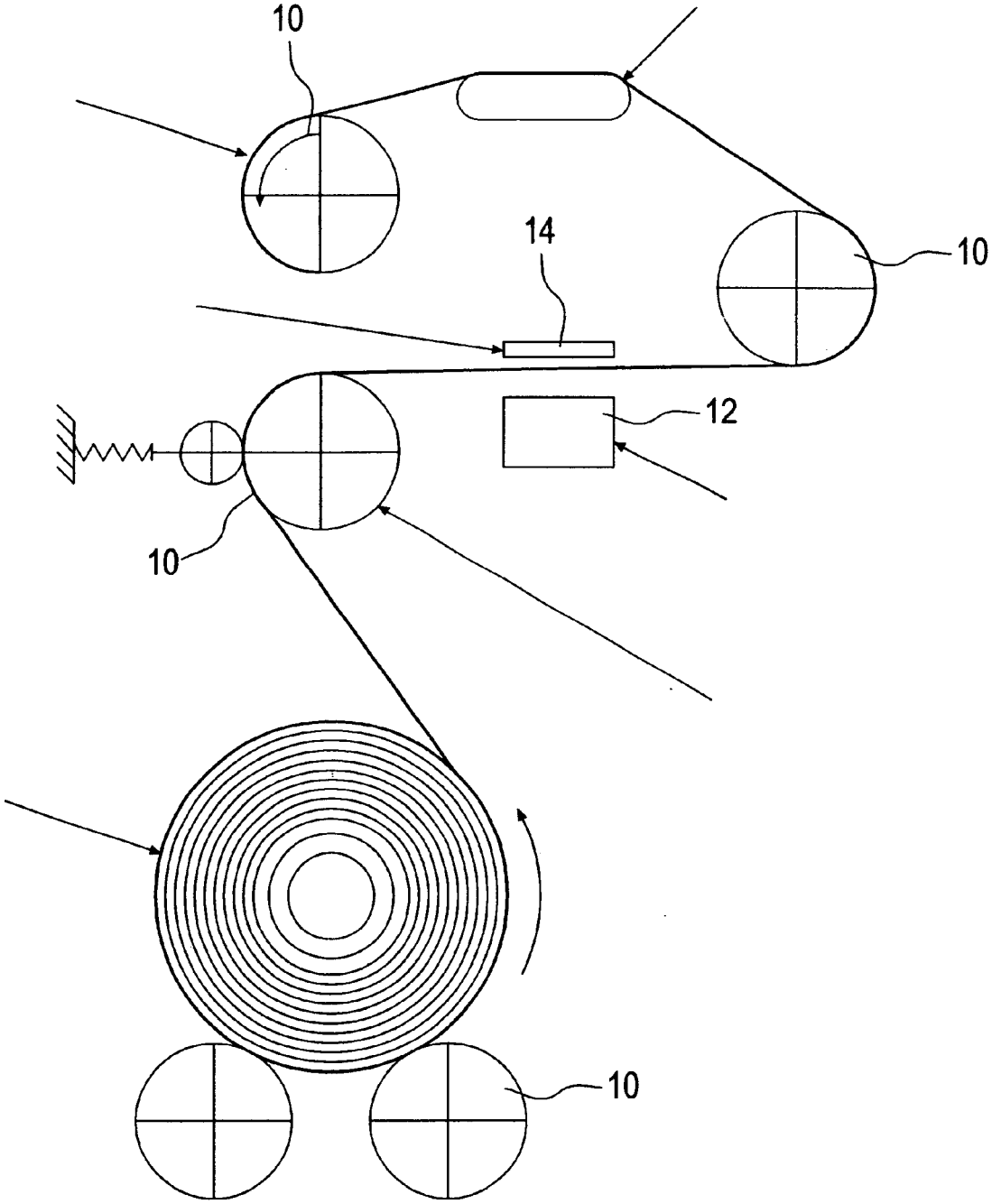
FIG.1 (PRIOR ART)
FIG. 1 is a schematic side cross-sectional view of a first prior art printer for flexible substrates.
Figure 2:
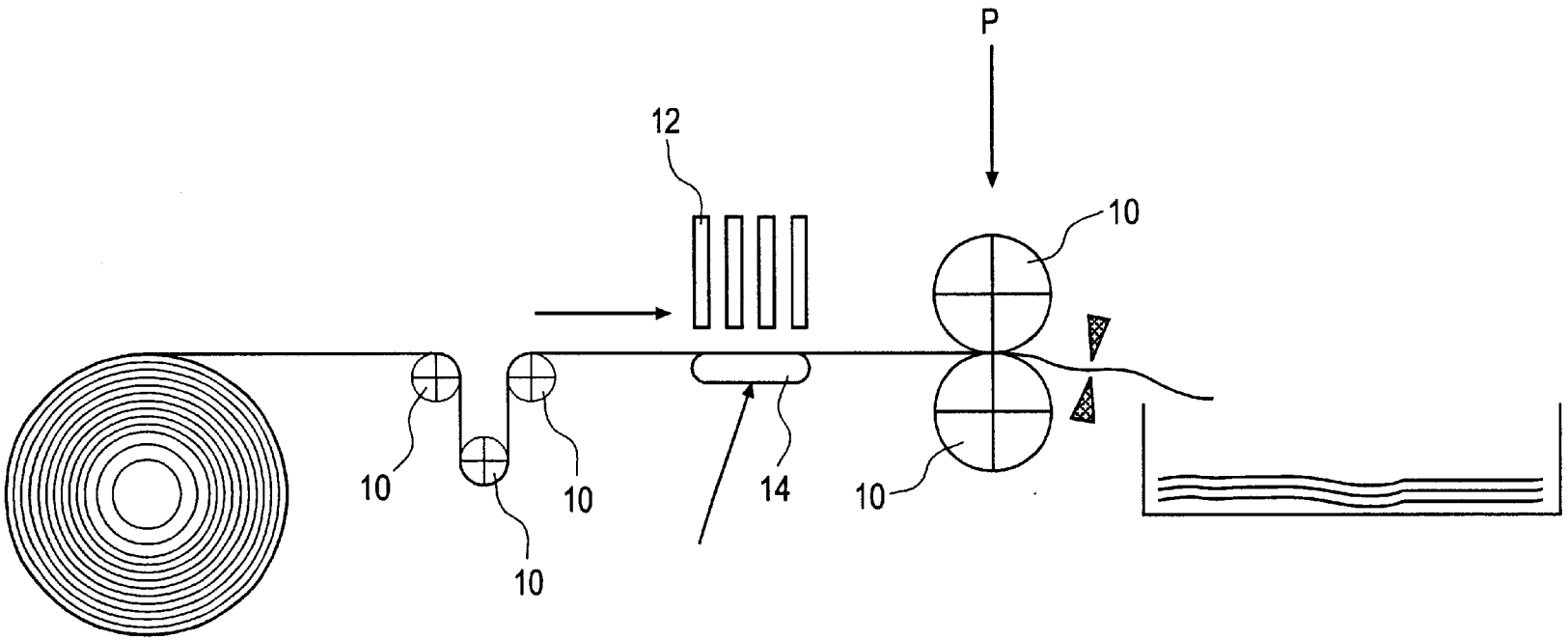
FIG.2 (PRIOR ART)
FIG. 2 is a schematic side cross-sectional view of a second prior art printer for flexible substrates.
Figure 3:
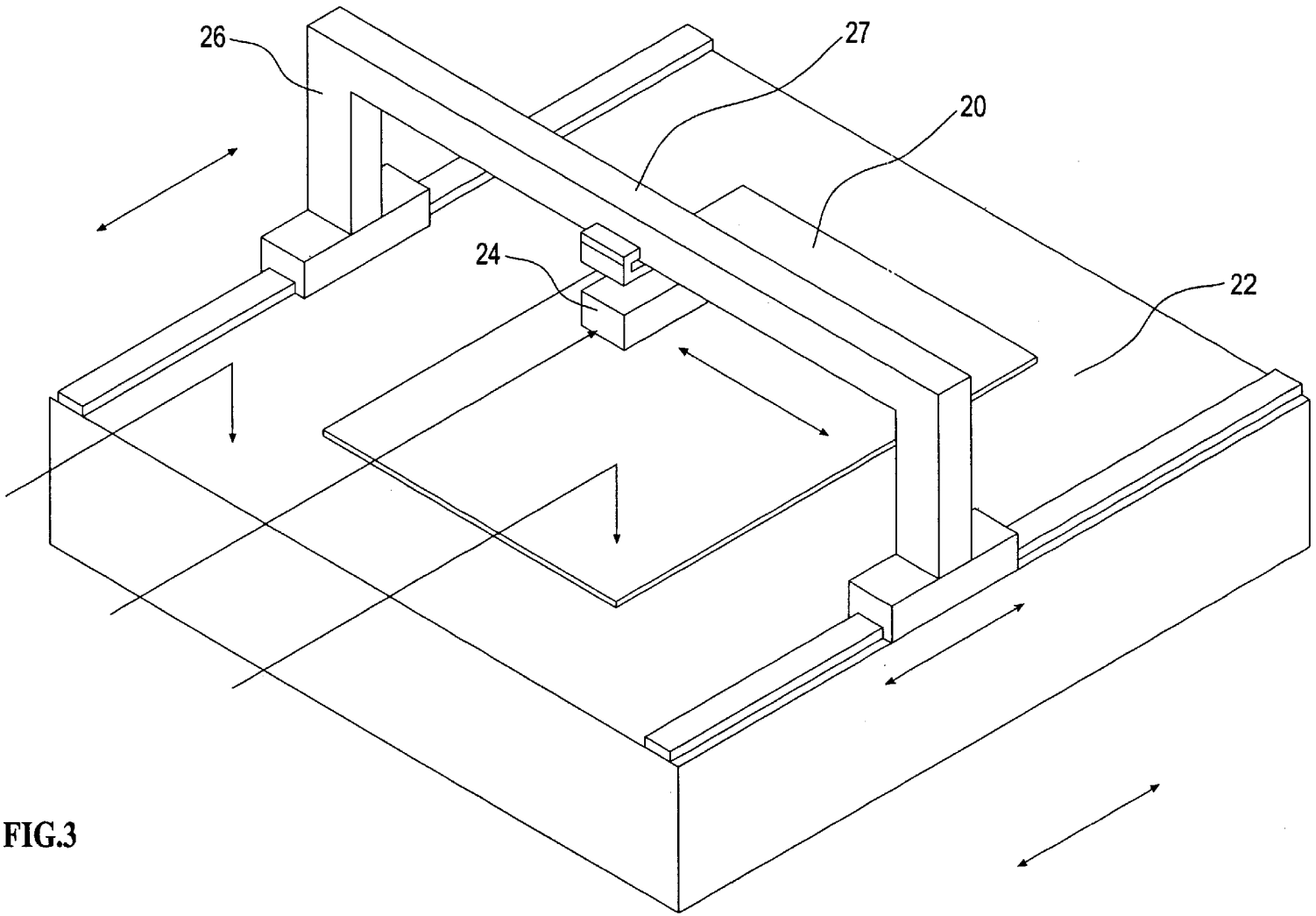
FIG. 3 is a schematic isometric view of a printer for rigid substrates based on a plotter-type configuration.

It will be readily appreciated that dual-mode printer 40 offers a highly versatile and cost effective solution for users with varied printing needs. In the flexible substrate mode, printer 40 typically operates in a manner completely equivalent to a conventional flexible-substrate printer such as those of FIGS. 1 and 2. Then, when printed matter is to be applied to a rigid substrate, the substrate is mounted on support surface 44 to allow printing directly onto the substrate in a mode similar to that of FIG. 3.

In an alternative set of implementations, the flexible substrate mode may also print over the full area employed for rigid substrate printing, the feed system being used as a "frame advance" to shift the substrate ready for printing of the next region. Such a mode is particularly suited to applications in which print head 52 is elongated in a direction parallel to feed direction 50 and motion system 54 generates relative movement exclusively in a direction 57 perpendicular to feed direction 50.

Preferably, an adjustment mechanism (not shown) is provided, typically associated with print head 52 and/or motion system 54, to allow adjustment of the clearance between print head 52 and support surface 44. This facilitates the use of printer 40 both with a wide range of types and thicknesses of flexible substrates and with a range of rigid substrates.

It should be appreciated that the principles of the present invention are applicable to printers of all types and sizes. Examples include, but are not limited to, inkjet printers of continuous-, piezo- and thermal-actuated types, laser printers and photo-static devices. In each case, the "printing medium" is selected accordingly: ink for inkjet-type applications; toner for laser printers and photo-static devices. The invention also applies to "printers" in the broadest sense of the term, whether in the form of stand-alone printers, copying systems or other applications. Preferably, the invention is applied to inkjet printers. In a most preferred embodiment, the invention is implemented as a "wide format" printer accommodating substrates of width W (perpendicular to feed direction 50) of at least about 70 cm.

Turning now to the features of printer 40 in more detail, it will be appreciated that the dimensions of table 42, and the corresponding range of relative movement between print head 52 and support surface 44 defined by motion system 54, may be freely chosen according to the dimension of rigid substrates to be accommodated. Clearly, the dimension perpendicular to feed direction 50 must also be sufficient to accommodate the maximum intended width of flexible substrates to be used, while the dimension parallel to feed direction 50 may be either larger or smaller. Preferably, the dimension of table 42 parallel to feed direction 50 is no less than about 10%, and most preferably at least about 20%, of the dimension parallel to feed direction 50. Furthermore, in preferred implementations in which motion system 54 generates motion in direction 56 parallel to the feed direction, the dimension of table 42 parallel to feed direction 50 is at least twice, and preferably an order of magnitude greater than, the operative dimension of print head 52 in the same direction. The table may be inclined as shown, horizontal, or at any other orientation desired.

The motion system may be configured to generate relative movement between print head 52 and support surface 44 by moving either (or in principle both) of print head 52 and support surface 44. In most cases, print head 52 is smaller and lighter, making it the preferable choice to move.

It will be appreciated that, in many cases, the primary difference between operation of printer 40 in its flexible- and rigid-substrate modes is whether relative motion between print head 52 and support surface 44 in a direction 56 parallel to feed direction 50 is generated at least in part by the feed system or exclusively by motion system 54. In the case of a full-width print head which can print simultaneously across substantially the entire width of the substrate, movement in direction 56 is typically the only movement required. In many cases, however, a narrower print head is used, as shown in FIG. 4. In such cases, motion system 54 is further configured to displace print head 52 relative to support surface 44 in a direction 57 perpendicular to feed direction 50, so as to span the width of the substrate. This latter function of motion system 54 is used during printing in both the flexible-substrate mode and the rigid-substrate mode.

It should be noted that, for simplicity of presentation, the present invention has been illustrated in a highly schematic manner without details of mechanisms and electronic components which are not part of the inventive content per se. Numerous options for actuating the feed mechanism and movement of motion system 54 in one or two dimensions are well known in the art. Typical examples for actuation of the feed mechanism include the use of a system of meshed gears driven from a servo-motor or step-motor. A typical example for motion system 54 employs a sliding bridge 60 as shown with one or more drive mechanism for moving print head 52 along bridge 60, and bridge 60 across support surface 44. Examples of suitable drive mechanisms include, but are not limited to, linear motors and closed loop belts, cables or threaded drive shafts driven by step-motors.

Similarly, electronic control systems suitable for actuating print head 52 in a manner synchronized with the feed mechanism and motion system 54 are well known in the art and are therefore not discussed here. The control system is unusual only in that it provides for the two different modes of operation as described above. Switching between the modes may be performed manually by operation of a user operated switch or other input, or automatically such as by a sensor for identifying the presence of a flexible substrate at some point within the feed system.

Finally, to ensure proper operation of printer 40 in the rigid-substrate mode, table 42 preferably includes a retention system for holding the rigid substrate in a given position on support surface 44. In a simple implementation, the retention system could be a number of low-profile mechanical clips or clamps. In a preferred implementation, the retention system includes a vacuum system 62 configured to apply suction to a plurality of apertures 64, typically forming an array across at least part of support surface 44.

It will be appreciated that the above descriptions are intended only to serve as examples, and that many other embodiments are possible within the spirit and the scope of the present invention.

What is claimed is:

1. A dual-mode printer for printing on both flexible and rigid substrates, the printer comprising:

(a) a table providing a substantially planar support surface for supporting a substrate;

(b) a flexible-substrate feed system including at least one roller, said flexible-substrate feed system being configured to feed a flexible substrate in a given feed direction across said support surface;

(c) a print head deployed in facing relation to said support surface and configured for depositing a printing medium on a substrate as part of a printing process, said print head being configured for printing while moving in a scanning motion relative to the substrate; and (d) a motion system associated with said print head and said table, and configured to generate relative displacement between said print head and said support surface in at least a first direction parallel to said feed direction, wherein said flexible-substrate feed system, said print head and said motion system are configured to operate alternatively in a flexible-substrate mode in which a scanning motion of said print head relative to the substrate is generated at least in part by said flexible-substrate feed system and in a rigid-substrate mode in which a scanning motion of said print bead relative to the substrate is generated exclusively by said motion system.

2. The dual-mode printer of claim 1, wherein said motion system is further configured to displace said print head relative to said support surface in a second direction perpendicular to said feed direction, said motion system being operative to displace said print head in said second direction during printing in both said flexible-substrate mode and said rigid-substrate mode.

3. The dual-mode printer of claim 1, wherein said print head has a major dimension and a minor dimension, said major dimension being deployed substantially perpendicular to said feed direction.

4. The dual-mode printer of claim 1, wherein said motion system is configured to displace said print head additionally in a direction substantially perpendicular to said feed direction.

5. The dual-mode printer of claim 1, wherein said printing medium is an ink and wherein said print head is an inkjet head configured for simultaneously depositing a plurality of drops of ink onto the substrate.

6. The dual-mode printer of claim 1, wherein said table includes a retention system for holding the rigid substrate in a given position on said support surface.

7. The dual-mode printer of claim 6, wherein said retention system includes a vacuum system configured to apply suction to a plurality of apertures formed in said support surface.

8. A dual-mode printer for printing on both flexible and rigid substrates, the printer comprising:

a table providing a substantially planar support surface for supporting a substrate;

(b) a flexible-substrate feed system including at least one roller, said flexible-substrate feed system being configured to feed a flexible substrate in a given feed direction across said support surface;

(c) a print head deployed in facing relation to said support surface and configured for depositing a printing medium on a substrate as part of a printing process, said print head being configured for printing while moving in a scanning motion relative to the substrate; and d) a motion system associated with said print head and said table, and configured to generate relative displacement between said print head and said support surface in at least a first direction parallel to said feed direction, wherein said flexible-substrate feed system, said print head and said motion system are configured to operate alternatively in a flexible-substrate mode in which a scanning motion of said print head relative to the substrate is generated at least in part by said flexible-substrate feed system and in a rigid-substrate mode in which a scanning motion of said print head relative to the substrate is generated exclusively by said motion system.

9. The dual-mode printer of claim 8, wherein said printing medium is an ink and wherein said print head is an inkjet head configured for simultaneously depositing a plurality of drops of ink onto the substrate.

10. The dual-mode printer of claim 8, wherein said motion system is further configured to displace said print head relative to said support surface in a second direction perpendicular to said feed direction, said motion system being operative to displace said print head in said second direction during printing in both said flexible-substrate mode and said rigid-substrate mode.

11. The dual-mode printer of claim 8, wherein said table includes a retention system for holding the rigid substrate in a given position on said support surface.

12. The dual-mode printer of claim 11, wherein said retention system includes a vacuum system configured to apply suction to a plurality of apertures formed in said support surface.

* * * * *